US006568667B1

(12) United States Patent
Hall

(10) Patent No.: US 6,568,667 B1
(45) Date of Patent: May 27, 2003

(54) QUICK SETUP APPARATUS FOR BAR CLAMP OPERATED WITH ONE HAND

(76) Inventor: John R. Hall, 38 Willow La., New Hartford, CT (US) 06057

( * ) Notice: Subject to any disclaimer, the term of this patent is extended or adjusted under 35 U.S.C. 154(b) by 0 days.

(21) Appl. No.: 10/064,788

(22) Filed: Aug. 16, 2002

(65) Prior Publication Data

(65)

(51) Int. Cl.[7] ..... B25B 1/00

(52) U.S. Cl. ..... 269/6; 269/3; 269/170; 269/216

(58) Field of Search ..... 269/6, 3, 212–215, 269/166–171.5

(56) References Cited

U.S. PATENT DOCUMENTS 4,989,847 A * 2/1991 Chapman ..... 269/170
5,022,137 A * 6/1991 Sorensen et al. ..... 269/6
5,222,420 A * 6/1993 Sorensen et al. ..... 269/6
6,338,475 B1 * 1/2002 Ping ..... 269/6
6,367,787 B1 * 4/2002 Poole et al. ..... 269/6

* cited by examiner

*Primary Examiner*—Lee D. Wilson
(74) *Attorney, Agent, or Firm*—William C. Crutcher

(57) ABSTRACT

A bar clamp of the type operated with one hand to advance a movable jaw toward a fixed jaw to clamp workpieces and having a holding brake with release mechanism is modified according to the invention to provide a quick set up apparatus. The modified bar clamp adds a spring and adjustable stop to allow opening the clamp to a wide position. The release mechanism then is triggered to close the jaws on the work before operating the advancing mechanism in the usual manner.

6 Claims, 5 Drawing Sheets

QUICK SETUP APPARATUS FOR BAR CLAMP OPERATED WITH ONE HAND

BACKGROUND OF INVENTION

This invention relates to bar clamps of the type designed to be operated by one hand to ratchet a movable jaw carrier along the bar toward a fixed jaw, with provision for releasing the movable jaw carrier.

A well-known type of bar clamp in the prior art is designed to be operated by one hand, while the other hand holds the work to be clamped between the fixed and movable jaw of the bar clamp. In most cases the jaws are opened wider than the work to be clamped, and it they are too wide, much time is wasted in ratcheting the movable jaw along the bar with the handle provided for this purpose. This is especially the case when repetitively clamping objects of varying dimensions, since the tendency is to set the movable jaw with a generous opening, so that it doesn't have to be corrected if the opening is too small. The only other alternative is to resort to using both hands, which is difficult if one hand is needed to hold the objects to be clamped.

Accordingly, one object of the invention is to provide an improved bar clamp of the type described above, which can be quickly set to the correct position to begin clamping.

Another object of the invention is to provide an improved bar clamp of the type described that can be set up with one hand.

SUMMARY OF INVENTION

Briefly stated the invention comprises an improvement to a bar clamp of the type having a bar, a fixed jaw disposed on the bar, and a movable jaw arranged to slide along the bar to and from said fixed jaw, said movable jaw adapted in a known manner to be operated with one hand and having an advancing means arranged to ratchet the movable jaw step-wise toward the fixed jaw and a holding means with a release mechanism arranged to prevent the movable jaw from moving away from the advanced position until released by the release mechanism, said bar clamp being known in the prior art, the improvement comprising an abutment member disposed on the bar on the side of the movable jaw opposite that of the fixed jaw, and a spring member disposed along the bar between the abutment member and the movable jaw and arranged to create a force biasing the movable jaw toward the fixed jaw.

BRIEF DESCRIPTION OF DRAWINGS

The invention will be better understood by reference to the following description, taken together with the accompanying drawings, in which.

DETAILED DESCRIPTION

Figure 1:
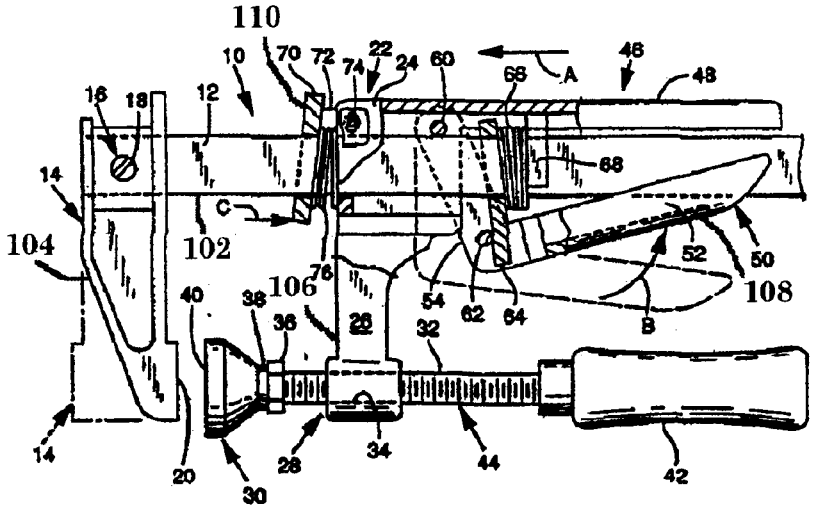
FIG. 1 (Prior Art)
FIGS. 1, 2 and 3 are horizontal elevation views of three types of prior art bar clamps as depicted in U.S. Pat. Nos. 4,989,847, 5,022,137 and 5,197,360, respectively.
Figure 2:
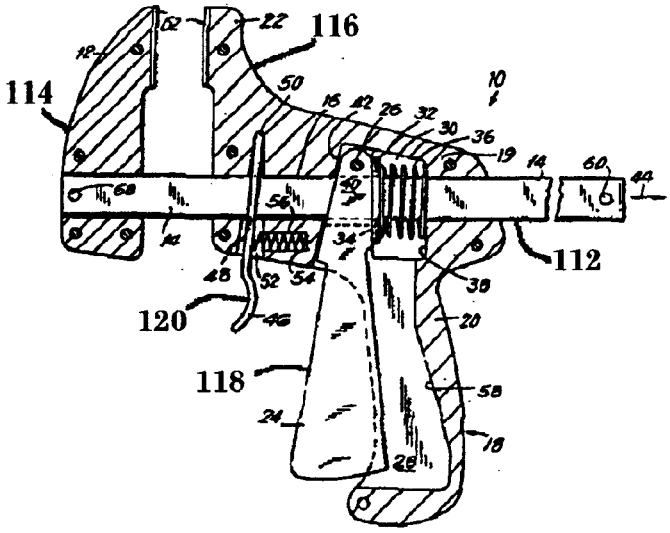
FIG. 2 (Prior Art)
Figure 3:
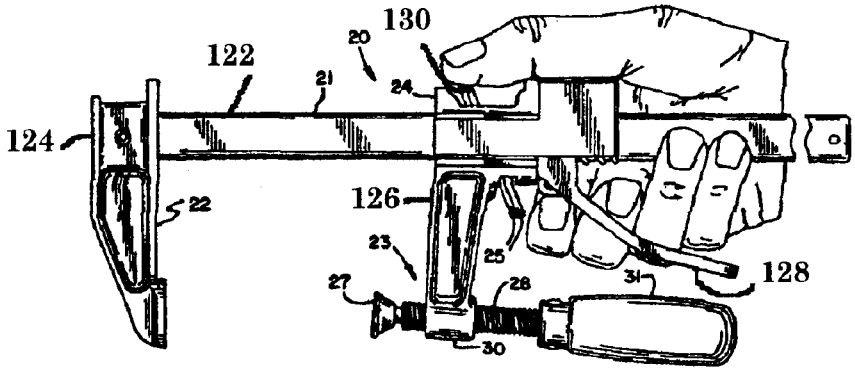
FIG. 3 (Prior Art)

Referring to the prior art drawings of FIGS. 1, 2 and 3, bar clamps are shown which are designed to be operated with one hand. The details and operation of the FIG. 1 clamp are found in U.S. Pat. No. 4,989,847 issued Feb. 5, 1991 to Chapman, which is incorporated herein by reference. The details and operation of the FIG. 2 clamp are found in U.S. Pat. No. 5,022,137 issued Jun. 11, 1991 to Sorensen, which is incorporated herein by reference. The details and operation of the FIG. 3 clamp are found in U.S. Pat. No. 5,197,360 issued Mar. 30, 1993 to Wooster, which is incorporated herein by reference. The reference numbers lower than those commencing with 100 are those used in the respective prior art patents and may be disregarded in the present application.

Referring to FIG. 1, a known bar clamp comprises a bar 102, a fixed jaw 104 disposed on the bar, and a movable jaw 106 arranged to slide along the bar to and from the fixed jaw adapted in a known manner to be operated with one hand and having an advancing means 108 arranged to ratchet the movable jaw step-wise toward the fixed jaw and a holding means with a release mechanism 110 arranged to prevent the movable jaw from moving away from the advanced position until released by the release mechanism.

Referring to FIG. 2, a known bar clamp comprises a bar 112, a fixed jaw 114 disposed on the bar, and a movable jaw 116 arranged to slide along the bar to and from the fixed jaw adapted in a known manner to be operated with one hand and having an advancing means 118 arranged to ratchet the movable jaw step-wise toward the fixed jaw and a holding means with a release mechanism 120 arranged to prevent the movable jaw from moving away from the advanced position until released by the release mechanism.

Referring to FIG. 3 a known bar clamp comprises a bar 122, a fixed jaw 124 disposed on the bar, and a movable jaw 126 arranged to slide along the bar to and from the fixed jaw adapted in a known manner to be operated with one hand and having an advancing means 128 arranged to ratchet the movable jaw step-wise toward the fixed jaw and a holding means with a release mechanism 130 arranged to prevent the movable jaw from moving away from the advanced position until released by the release mechanism.

The above described bar clamps are very useful when operated with one hand if the fixed jaw and the movable jaw have the proper spacing when the ratcheting action is commenced. However, if the jaws are too far apart, the operator must operate the advancing means for a long time until the jaws close to the proper distance to commence clamping action. The present invention provides a simple modification to quickly set up the jaws to the proper distance before the ratcheting action is commenced.

Figure 4:
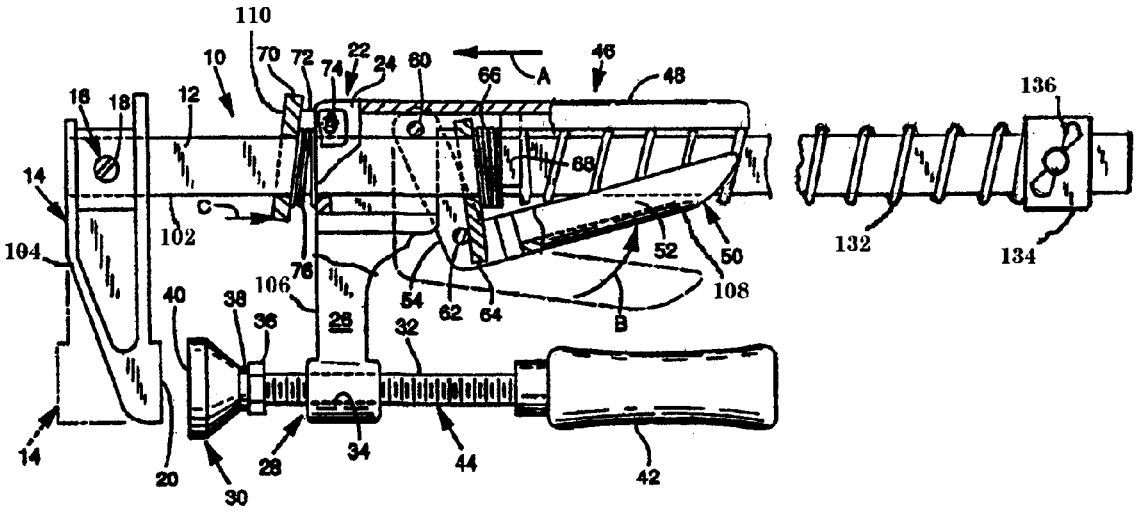
FIG. 4 is a horizontal elevation view of the bar clamp of FIG. 1 modified according to the present invention.

Referring to FIG. 4 of the drawing the FIG. 1 prior art bar clamp has been modified by placing a compression spring 132 around bar 102 on the side of movable jaw 106 opposite the fixed jaw 104. An adjustable stop comprising an abutment member 134 with manually actuated clamping means such as thumbscrew 136. The adjustable stop is arranged to be slidable along the bar and held in a selected position on the bar by tightening the thumbscrew 136. The spring 132 provides a biasing force between the adjustable stop and the movable jaw, which tends to move the bar and the fixed jaw through the movable jaw in a closing direction when the bar clamp is held by the handle on the movable jaw. The bar 102 is prevented from moving through the movable jaw until it is released by the release mechanism 110 on the holding means.

The number of turns and wire gauge used in the compression spring are selected with regard to the length of the bar so as to allow the jaws to operate over a reasonable distance between fully compressed and fully extended end positions of spring 132. The spring may be round, or may also be wound so as to have an oval or elliptical cross-section, so as to conform more closely to the cross-section of the bar Referring to FIGS. 5A and 5B of the drawing, the FIG. 2 prior art bar clamp has been modified by placing a compression spring 138 around bar 112 on the side of movable jaw 116 opposite the fixed jaw 114. An adjustable stop comprising an abutment member 140 with thumbscrew 142 is arranged to be slidable along the bar and held in a selected position on the bar by tightening the thumbscrew 142. The spring 138 provides a biasing force between the adjustable stop and the movable jaw, which tends to move the bar and the fixed jaw through the movable jaw in a closing direction. The bar 112 is prevented from moving through the movable jaw until it is released by the release mechanism 120 on the holding means.

Figure 6:
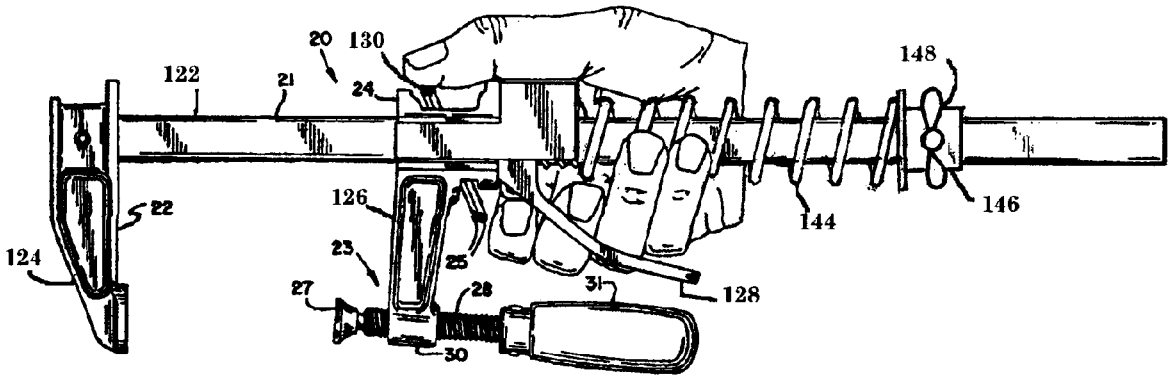

Referring to FIG. 6 of the drawing the FIG. 3 prior art bar clamp has been modified by placing a compression spring 144 around bar 102 on the side of movable jaw 126 opposite the fixed jaw 124. An adjustable stop comprising an abutment member 146 with thumbscrew 148 is arranged to be slidable along the bar and held in a selected position on the bar by tightening the thumbscrew 148. The spring 144 provides a biasing force between the adjustable stop and the movable jaw, which tends to move the bar and the fixed jaw through the movable jaw in a closing direction. The bar 122 is prevented from moving through the movable jaw until it is released by the release mechanism 130 on the holding means.

Operation

Figure 5A:
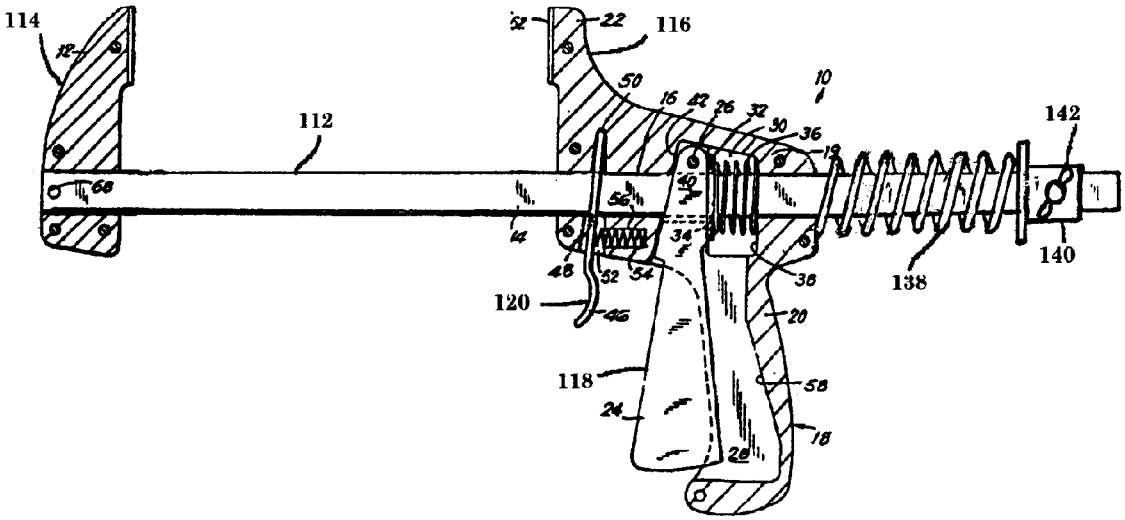
FIGS. 5A and 5B are horizontal elevation views of the bar clamp of FIG. 2 modified according to the present invention, shown in open and closed views, respectively, and, FIG. 6 is a horizontal elevation view of the bar clamp of FIG. 3 modified according to the present invention.

Operation of the invention will be made clear by reference to FIGS. 5A and 5B. FIG. 5A illustrates the bar clamp in an open position. To place the bar clamp in-an open position, the fixed jaw 114 is held with one hand, the release mechanism 120 actuated, and the movable jaw 116 is moved toward the right against the biasing force of compression spring 138. The movable jaw remains in this position when release mechanism 120 is no longer actuated. With the grip of the movable jaw 116 held in one hand the compression spring 138 is now pushing against the adjustable stop 140 and trying to move the fixed jaw 114 and the bar 112 to the right. The work to be clamped can be arranged and held with the other hand. Then the release mechanism is actuated.

Figure 5B:
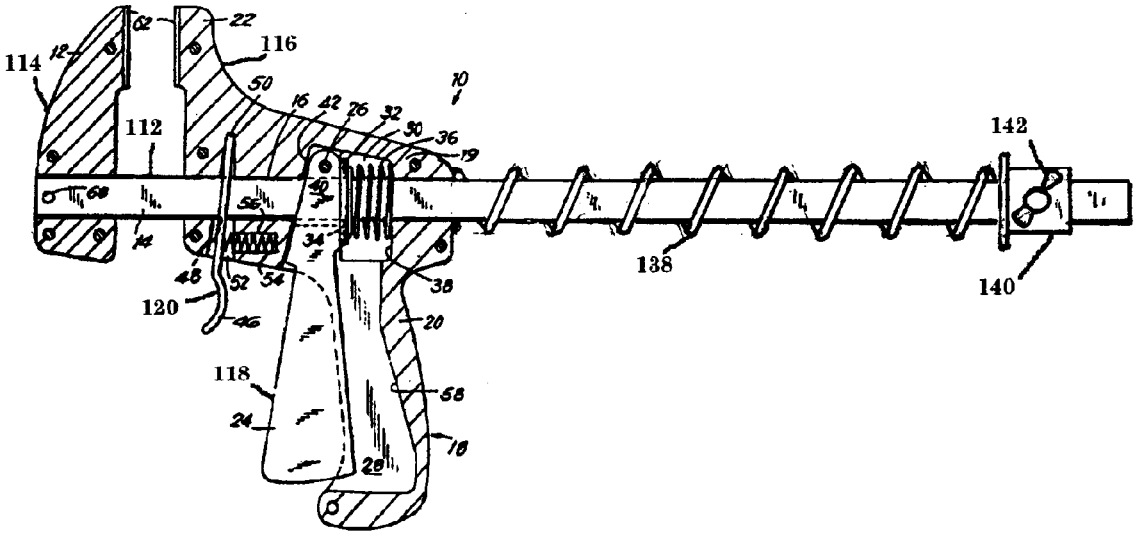

Reference to FIG. 5B illustrates the bar clamp in a closed position. Fixed jaw 114 and bar 112 snap to a closed position about the work pieces (not shown). Thereafter, using the same one hand the advancing mechanism 118 is actuated in the normal manner to apply full clamping force. Thereafter, if desired, the release mechanism 120 may be operated with the same hand in the usual manner.

Thus a quick setup of work to be clamped is facilitated by the invention. To change the initial open position, it is only necessary to loosen thumbscrew 142, slide the adjustable stop 140 to a different position and then re-tighten the thumbscrew.The modified bar clamps of FIGS. 4 and 6 are operated in a similar manner, using the advancing means and release mechanisms in the manner required by those particular bar clamps. When reference is made to a movable jaw, it is understood that this is with reference to the bar. When the movable jaw is held by the handle, it is not being moved; the bar and fixed jaw are moving with respect to the handle.

While there is described what is considered to be the preferred form of the invention, other modifications will become apparent to those skilled in the art, and it is desired to cover in the appended claims all modifications which fall within the true spirit and scope of the invention.

What is claimed is:

1. Improvement in a bar clamp of the type having a bar, a fixed jaw disposed on the bar, and a movable jaw arranged to slide along the bar to and from said fixed jaw, said movable jaw adapted in a known manner to be operated with one hand and having an advancing means arranged to ratchet the movable jaw step-wise toward the fixed jaw and a holding means with a release mechanism arranged to prevent the movable jaw from moving away from the advanced position until released by the release mechanism, said bar clamp being known in the prior art, said improvement comprising:an abutment member disposed on the bar on the side of the movable jaw opposite that of the fixed jaw, a spring member extending along the bar between the abutment member and the movable jaw and arranged to create a force biasing the movable jaw toward the fixed jaw.

2. The combination according to claim 1, wherein the spring member is a compression spring threaded on the bar between the movable jaw and the abutment member.

3. The combination according to claim 1, wherein the abutment member is slidably disposed on the bar, said abutment member having a manually actuated clamping means for selectively preventing the member from sliding on the bar, whereby the abutment member comprises an adjustable stop.

4. The combination according to claim 3, wherein said clamping means is a thumbscrew arranged to be tightened against the bar.

5. Improvement to a bar clamp of the type having a bar, a fixed jaw disposed on the bar, and a movable jaw arranged to slide along the bar to and from said fixed jaw, said movable jaw adapted in a known manner to be operated with one hand and having an advancing means arranged to ratchet the movable jaw step-wise toward the fixed jaw and a holding means with a release mechanism arranged to prevent the movable jaw from moving away from the advanced position until released by the release mechanism, said bar clamp being known in the prior art, said improvement comprising: an abutment member disposed on the bar on the side of said movable jaw opposite that of said fixed jaw, and a compression spring extending along the bar between the movable jaw and the abutment member, so as to provide a force biasing the movable jaw toward the fixed jaw.

6. The combination according to claim 5, wherein the abutment member is slidably disposed on the bar and including manually actuated clamping means disposed on the abutment member and arranged to selectively prevent it from sliding on the bar, wherein the abutment member serves as an adjustable stop.

* * * * *